US005090998A

United States Patent [19]

Buxmann

[11] Patent Number: 5,090,998

[45] Date of Patent: Feb. 25, 1992

[54] PURIFICATION OF METAL MELTS WITH HALOGEN GAS GENERATED IN AN ELECTROLYSIS CELL

[75] Inventor: Kurt Buxmann, Sierre, Switzerland

[73] Assignee: Alusuisse-Lonza Services Ltd., Chippis, Switzerland

[21] Appl. No.: 625,203

[22] Filed: Dec. 10, 1990

[30] Foreign Application Priority Data

Dec. 20, 1989 [CH] Switzerland ..... 4556/89

[51] Int. Cl.[5] ..... C22B 21/06

[52] U.S. Cl. ..... 75/375; 75/407; 75/412; 75/414; 75/681

[58] Field of Search ..... 75/412, 681, 407, 375, 75/414

[56] References Cited

U.S. PATENT DOCUMENTS

| | | | |
|---|---|---|---|
| 3,508,908 | 4/1970 | Herwig et al. | 75/681 |
| 3,958,980 | 5/1976 | Szekely | 75/681 |
| 3,958,981 | 5/1976 | Forberg et al. | 75/681 |
| 4,681,152 | 7/1987 | Flowers et al. | 75/412 |

FOREIGN PATENT DOCUMENTS 0061411 9/1982 European Pat. Off. .

1010418 11/1965 United Kingdom .

OTHER PUBLICATIONS

G. A. Hampel, "The Encyclopedia of Electrochemistry", 1984, pp. 592-593.

*Primary Examiner*—Melvyn J. Andrews

*Attorney, Agent, or Firm*—Bachman & LaPointe

[57] ABSTRACT

The process for purifying a metal melt operates with an active gas introduced into the lower region thereof and consisting of an inert carrier gas and an active, gaseous halogen which are introduced under control into a vessel with the stagnant or flowing metal melt.

The active, gaseous halogen is generated at a controlled rate in at least one gas evolution cell and introduced into the carrier gas. The active gas mixture is passed directly into the metal melt. The gas feed line of the halogen does not have any control element.

The gas evolution cell for generating the halogen is preferably an exchangeable electrolysis cell, gas being produced only when the electrolysis current is switched on, which follows a nominal curve proportionally to the current intensity.

12 Claims, 1 Drawing Sheet

PURIFICATION OF METAL MELTS WITH HALOGEN GAS GENERATED IN AN ELECTROLYSIS CELL

Figure 1:
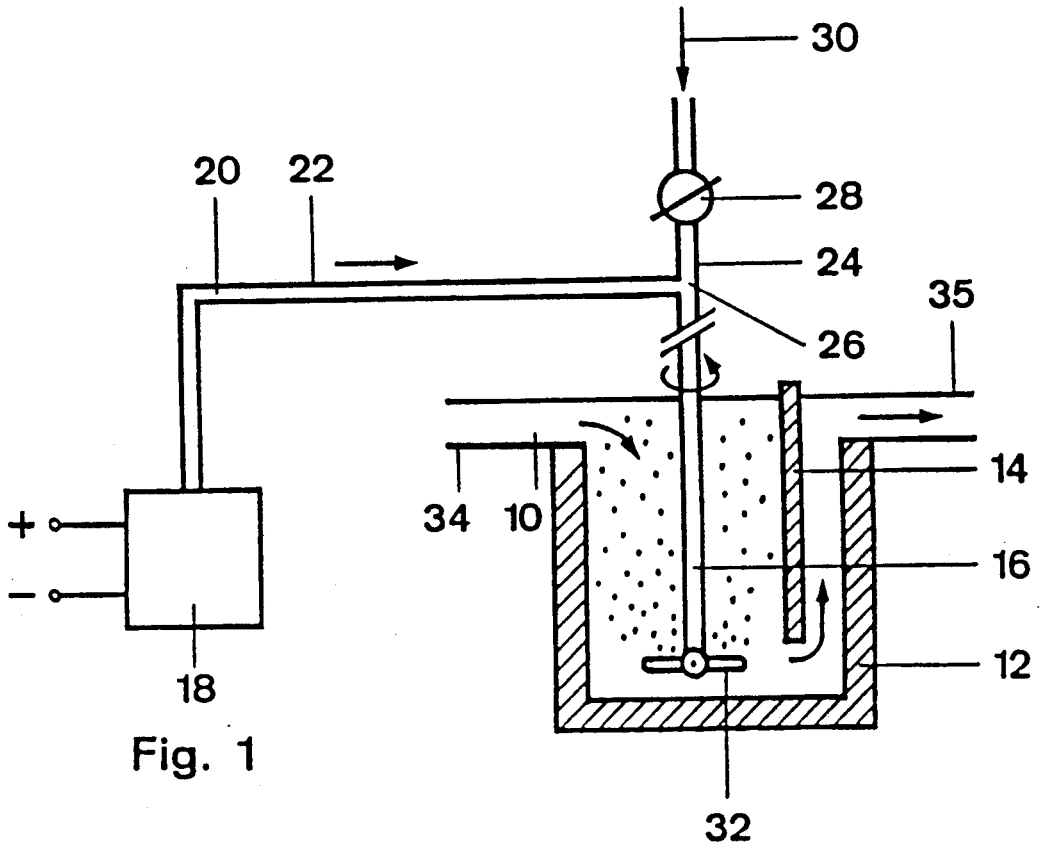

The invention relates to a process for purifying a metal melt by means of an active gas introduced into the lower region thereof and consisting of an inert carrier gas and an active, gaseous halogen which are introduced at a controlled rate into a vessel with the stagnant or flowing metal melt. The invention also relates to equipment for carrying out the process and to a use of the process.

Quite generally, the purpose of a melt purification is to reduce the concentration of both dissolved components and gaseous or solid inclusions to an acceptable level. To this end, a number of melt purification processes have been developed in various metal foundries, some of which may be mentioned:

flushing gas treatment with an inert gas, for example argon and/or nitrogen, flushing gas treatment with an activated inert gas which contains an addition of an active gas, for example chlorine or a Freon, exclusively filtration of the melt, combined flushing gas and filtration treatment, vacuum treatment.

Of these processes known to those skilled in the art, the flushing gas treatment with an activated inert gas is of particular interest, at least in the present case.

A pure inert gas exerts an exclusively physical action, the metal ions diffusing, due to their vapor pressure, into the bubbles and small bubbles of an inert gas rising in a melt and being carried to the metal surface, where the dross forms.

The addition of an active component, for example chlorine, effects a chemical reaction in addition to the physical one. A gaseous halogen, introduced in a dilute state, oxidizes the alkali metals and alkaline earth metals which are dissolved in the molten metal and which are separated out, after rising, as halides in the dross. The argon and/or nitrogen used as the carrier gas for the gaseous halogen is at the same time capable of reducing the hydrogen content of the melt.

Apart from the fact that the higher efficacy in the case of the addition of an active gas to an inert gas must be paid for by higher losses as dross, the compatibility of the halogens used in foundries with the environment is increasingly becoming the focus of attention. The dilution of the gaseous halogens used with an inert carrier gas has alleviated the problems with respect to the environment and occupational hygiene. With a program-controlled process regulation, the addition can be carried out with such accuracy that the gaseous halogen contained in fine small bubbles is virtually fully converted to a metal halide. The remaining hydrogen halides can be scrubbed out of the exit gas at a corresponding cost. The important problems of foundries, which apply processes for purifying metal melts, are no longer in this field.

Of the gaseous halogens, chlorine is mainly used now, as already in the past This highly aggressive gas, which is hazardous in relatively large quantities, burdens the metal foundries with numerous statutory regulations and considerable operational problems:

The stock of gaseous halogen must be stored under a high pressure in a storage tank outside buildings, in a protected area. Not only the tank but also the supply technique and the rupture-proof line feeding the halogen to the melt must meet stringent requirements.

The required reducing valves for gaseous halogen cause high maintenance costs and, in addition, hazardous manipulations are necessary.

The unavoidable corrosion in the measuring and feeding devices leads not infrequently to a falsification of the indication. The person skilled in the art always remains uncertain whether in fact the correct rate of gaseous halogen is being fed. An excessive feed rate fed can pollute the environment and the workplace and lead to corrosion damage, and too small a rate leads to metallurgical uncertainties.

The present invention is based on the object of providing a process for purifying a metal melt of the type described above by means of which a dilute, active, gaseous halogen can be introduced at a controlled rate into a metal melt, without the above disadvantages. Equipment for carrying out the process thereof is also to be provided.

With respect to the process, the object is achieved according to the invention when the active, gaseous halogen is generated under control in at least one gas evolution cell and introduced into the carrier gas, and the active gas mixture is passed directly into the metal melt.

The difference, essential to the invention, from the known state of the art is therefore that it is no longer necessary to generate a halogen in a large quantity, transporting it, storing it in the open, passing it via a rupture-proof line into the interior of a building and, in the latter, to add it at a controlled rate, but that the gaseous halogen is produced at that rate and for that time for which it has to be introduced into the melt. The controlled addition is effected no longer by one or more controlled feed devices prone to corrosion, but by varying the production parameters without any problems.

This becomes particularly clear in a preferred embodiment of the invention, according to which the gaseous halogen is generated under program control in an electrolysis cell, the gas generation being effected with respect to rate per unit time and duration by controlling the current intensity of the electrolysis current.

The rate of halogen introduced per unit time into the melt and correspondingly the current intensity of the electrolysis cell are controlled in accordance with a given program by the separately measured flow of the carrier gas stream; the metal flow (in the case of a flowing metal melt) and/or the concentration, measured above the treatment vessel, of reaction products or unspent halogen.

The gas generation starts when the electrolysis current is switched on and is instantly stopped when the current feed is interrupted. During the electrolysis process, the rate of gas formation is directly proportional to the direct current flowing. Since the electrolysis current can be controlled without problems and exactly, the feed rate of the gaseous halogen formed is correspondingly exact and is not impeded by any corrosion processes. The gaseous halogen, for example chlorine, can be added at the correct rate and for the required time, and there are neither metallurgical uncertainties due to an inadequate gas feed which may occur nor unnecessary pollution of the environment and workplace due to an unduly high gas feed. The rate of the halogen fed can be controlled in such a way that this halogen is virtually fully consumed.

The halogen evolved is preferably introduced into a gas stream of pure inert carrier gas, and a gas mixture is formed. For technical and economic reasons, the suitable carrier gases are above all argon and/or nitrogen. The addition of these inert gases can be controlled, for example, by means of conventional flowmeters, and they do not exert any corrosive action.

Preferably 0.5–10% by volume of a gaseous halogen, in particular 1–3% by volume, are admixed with the carrier gas. This dilution is known per se and is frequently applied in conventional processes.

The halogen source is caused to undergo an electrochemical reaction under program control, in the preparation of the halogens introduced in the gaseous state into the carrier gas. Preferred as the halogen source are hydrogen halide, for example hydrogen chloride, or an alkali metal salt of the respective halogen, for example common salt. These halogen sources are preferably added, preferably in a dissolved or liquefied state into an electrolysis cell of known construction. While the cell is fed with direct current, gaseous halogen is released proportionally to the current intensity. Hydrogen, the respective alkali metal or an alkali metal hydroxide solution are formed at the same time as a by-product. Because of the relatively small quantities of the gaseous halogen required, the by-products are as a rule not utilized, but burned (hydrogen) or neutralized (alkali metal hydroxide solutions).

Among the gaseous halogens used for purifying metal melts, chlorine has, as already mentioned, by far the greatest importance. This is produced from hydrochloric acid or common salt as the chlorine source. A foundry customer not infrequently demands explicitly that the metal delivered to him is purified with chlorine.

Even though the gaseous halogen diluted with inert carrier gas is in practice fed to the metal melt at a predetermined, constant rate, it is possible to fix a nominal curve for the time curve of the gas rate to be generated, owing to the controlled gas evolution in a cell, especially in an electrolysis cell. This curve can, depending on the specific requirement, not only run parallel to the time axis, but can be linear or rise or fall progressively or degressively. The gas can also be fed in pulses, with or without gas rates being generated between the pulses. Especially by means of an electrolysis cell, virtually any desired nominal curve can thus be fixed and followed under program control.

Using a known, hitherto conventional control of the feed of gaseous halogens to the carrier gas, such flexibility would be entirely inconceivable.

In the case of removing dissolved alkali metals and/or alkaline earth metals from a stagnant aluminum melt by means of chlorine, it is possible, for example, in accordance with the higher concentration of the impurities to be bound to chlorine, initially to generate a higher concentration of chlorine and to add this to the gas, preferably 3–20% by volume. Subsequently, the chlorine content is successively reduced, preferably slowly down to zero, corresponding to the falling impurity content of the melt. The result of this is that the degree of contamination of the melt is lowered to the desired level in a minimum of time, without excess chlorine being released. The gas feed devices can be immersed and pulled out again while pure inert gas flows out.

With respect to the equipment for carrying out the process, the object is achieved according to the present invention when a vessel with a metal melt is associated with at least one gas evolution cell for producing a gaseous halogen and with a gas feedline, leading into the metal melt, without a control device.

The associated gas evolution cells, in particular electrolyis cells, are known per se and can be taken from any relevant text book of electrochemistry. It is of significance essential to the invention that at least one of these cells is associated with a vessel containing a metal melt which is to be purified, and the control of a gaseous halogen generated is effected by controlling the production process and not by control instruments, for example flowmeters, installed in the gas feed line to the vessel containing the metal melt. These control instruments, which are attacked by the aggressive, gaseous halogens and operate unreliably due to corrosion damage, are therefore superfluous.

Preferably, the gas evolution cell(s) associated with a vessel containing a metal melt is/are exchangeable. Thus, on the one hand, the gas evolution cells can be used for different vessels for a metal melt and, on the other hand, a metal melt can, if necessary, be purified, even when relatively small cells are available, at a higher gas rate and/or by means of different gaseous halogens.

Even though the process according to the invention is quite generally applicable to the purification of metal melts, it is particularly suitable for purifying a melt of aluminum or an aluminum alloy with chlorine. Apart from hydrogen, dissolved alkali metals and alkaline earth metals, such as sodium, lithium, magnesium and calcium, can be removed virtually completely from the melt or reduced to the requisite level.

In a particularly advantageous manner, the process according to the present invention can be used for purifying a metal melt in a vessel which is located between a casting furnace and a casting machine and in which simultaneously a filter can be arranged for the removal of solid inclusions.

Figure 2:
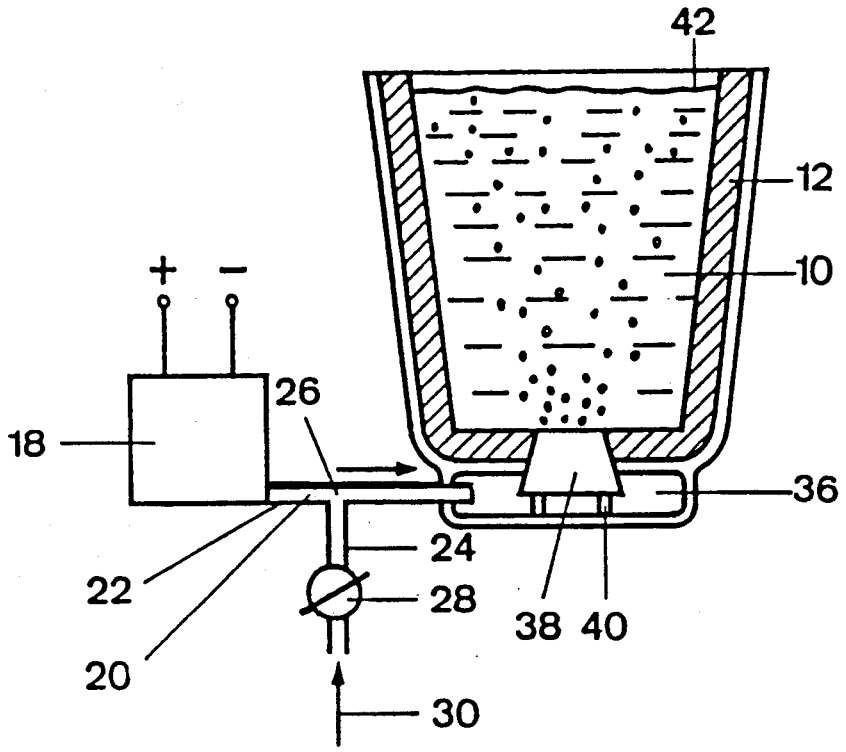

The invention is explained in more detail by reference to the illustrative examples represented in the drawing. In the sectional diagrammatic views:

FIG. 1 shows a vessel with the equipment for purifying metal melts in a continuous process, and FIG. 2 shows a vessel with equipment for purifying a stagnant metal melt.

The contaminated metal melt 10 is passed via an inlet 34 into a vessel 12. In this vessel, a deflection wall 14 is arranged which extends down as far as the region of the bottom and around which the metal melt 10 is passed and, after rising, discharged via an outlet 35. The metal melt 10 can also be passed through a filter (not shown) which retains solid inclusions.

A rotor 16 is immersed from above into the metal melt 10. Of course, a plurality of lances can be provided in the known manner in place of the rotor.

In an electrolysis cell 18 of known construction, fed by low-voltage direct current, a gaseous halogen 20, chlorine in the present case, is produced, which is passed through the feed line 22 in the direction of the vessel 12 containing the metal melt 10. The feedline 22 leads into a further feed line 24, with a flow control device 28 located upstream of the branch 26, for the inert gas 30.

Downstream of the branch 26, the common feed line 22, 24 for the inert carrier gas 30 diluted with gaseous halogen is connected to the rotor 16. A spraying disk 32, rotating with the latter, breaks up the fed, active gas into small gas bubbles which purify the metal melt 10, fed via the inlet 34, by removing hydrogen inclusions and dissolved alkali metals and alkaline earth metals.

The devices known per se for taking away and disposing of halogens, not consumed in the metal melt 10, and by-products of the electrolysis cell 18 are not shown, for the sake of clarity.

FIG. 2 shows a stagnant metal melt 10 in a vessel 12. The gaseous halogen is generated and fed in a manner corresponding to FIG. 1.

The gaseous halogen 20, diluted with inert gas 30 enters a distribution chamber 36 located underneath the vessel 12 and passes, from there, as finely divided small bubbles into the metal melt 10 via a bubble plug 38 with a holding device 40.

The alkali metals and alkaline earth metals reacting with the halogen collect in dross 42 floating on the metal melt 10 and can be removed with the former.

The principle, essential to the invention, of the direct generation of a gaseous halogen and the transfer thereof into the melt without any feed control devices can readily be seen from both figures.

I claim:

1. Process for purifying a metal melt by means of an active gas introduced into the lower region thereof, which comprises providing an inert carrier gas and an active, gaseous halogen, introducing said inert gas and halogen at a controlled rate into a vessel containing a metal melt wherein the active, gaseous halogen is generated in at least one gas evolution cell, including the step of controlling the gas generation with respect to rate per unit time and duration by controlling current intensity of the electrolysis current, and introducing the resultant generated gaseous halogen into the carrier gas, and thereafter the active gaseous halogen-carrier gas mixture is passed directly into the metal melt.

2. Process according to claim 1 including the step of introducing the active gaseous halogen-carrier gas mixture into a flowing metal melt.

3. Process according to claim 1 including the step of introducing the active gaseous halogen-carrier gas mixture into a stagnant metal melt.

4. Process according to claim 1 including the step of generating the gaseous halogen under a program control in an electrolysis cell.

5. Process according to claim 4 wherein at least one of reaction products and unspent halogen are present above the metal melt, and including the step of controlling the rate of halogen introduced per unit time into the metal melt in accordance with the given program by a method selected from the group consisting of: measuring the flow of the carrier gas; measuring the metal flow in the case of a flowing metal melt; measuring the concentration above the treatment vessel of at least one of reaction products and unspent halogen; and combinations thereof.

6. Process according to claim 1 including the step of selecting the carrier gas from the group consisting of argon, nitrogen, and mixtures thereof, and 0.5–10% by volume of a gaseous halogen is used as the active gas.

7. Process according to claim 6 including the step of selecting chlorine as the halogen.

8. Process according to claim 3 including the step of flushing with pure inert gas at the end of the purification of the stagnant metal melt.

9. Process according to claim 8 wherein said metal melt contains impurities, including the steps of generating and feeding an increased rate of gaseous halogen at the start of the purification of the metal melt, corresponding to the initially higher content of impurities, and successively reducing the halogen content.

10. Process according to claim 9 including the step of selecting a halogen-carrier gas mixture with a content of 3–20% by volume of gaseous halogen in the carrier gas at the start of the purification of the metal melt and subsequently successively reducing the volume of gaseous halogen in the carrier gas corresponding to the falling impurities content of the metal melt.

11. Process according to claim 1 including the step of purifying a melt of aluminum or an aluminum alloy with chlorine.

12. Process according to claim 11 wherein a casting furnace and casting machine are provided, and including the step of purifying the melt in a vessel located between the casting furnace and the casting machine, also with a filter for the removal of solid inclusions.

* * * * *